US011692142B2

(12) United States Patent
Weiss et al.

(10) Patent No.: US 11,692,142 B2
(45) Date of Patent: Jul. 4, 2023

(54) METHOD FOR CONVERTING FEEDSTOCKS COMPRISING A HYDROTREATMENT STEP, A HYDROCRACKING STEP, A PRECIPITATION STEP AND A SEDIMENT SEPARATION STEP, IN ORDER TO PRODUCE FUEL OILS

(71) Applicant: IFP Energies nouvelles, Rueil-Malmaison (FR)

(72) Inventors: Wilfried Weiss, Valencin (FR); Isabelle Merdrignac, Chaponnay (FR); Jeremie Barbier, Rive de Gier (FR); Ann Cloupet, Longes (FR)

(73) Assignee: IFP Energies nouvelles, Rueil-Malmaison (FR)

( * ) Notice: Subject to any disclaimer, the term of this patent is extended or adjusted under 35 U.S.C. 154(b) by 168 days.

(21) Appl. No.: 15/578,580

(22) PCT Filed: Apr. 20, 2016

(86) PCT No.: PCT/EP2016/058745
§ 371 (c)(1),
(2) Date: Nov. 30, 2017

(87) PCT Pub. No.: WO2016/192891
PCT Pub. Date: Dec. 8, 2016

(65) Prior Publication Data

US 2018/0163144 A1 Jun. 14, 2018

(30) Foreign Application Priority Data

Jun. 1, 2015 (FR) ..... 15/54.964

(51) Int. Cl.
*C10G 31/06* (2006.01)
*C10G 31/09* (2006.01)
(Continued)

(52) U.S. Cl.
CPC ..... *C10G 31/06* (2013.01); *C10G 31/09* (2013.01); *C10G 47/24* (2013.01); *C10G 49/002* (2013.01);
(Continued)

(58) Field of Classification Search
CPC ..... C10G 21/00; C10G 21/003; C10G 45/00; C10G 31/09; C10G 31/10; C10G 47/00;
(Continued)

(56) References Cited

U.S. PATENT DOCUMENTS 2,988,501 A 6/1961 Inwood et al.
3,477,943 A * 11/1969 Jacobs ..... C10G 45/04 208/59
(Continued)

FOREIGN PATENT DOCUMENTS

WO 2014096704 A1 6/2014

OTHER PUBLICATIONS

PubChem, Octadecane, <https://pubchem.ncbi.nlm.nih.gov/compound/octadecane#section=Crystal-Structures>, accessed on Mar. 4, 2020. (Year: 2020).*
(Continued)

*Primary Examiner* — Michelle Stein
(74) *Attorney, Agent, or Firm* — Millen, White, Zelano & Branigan, PC; Ryan Pool

(57) ABSTRACT

The invention concerns a process for the treatment of a hydrocarbon feed, said process comprising the following steps: a) a hydrotreatment step, in which the hydrocarbon feed and hydrogen are brought into contact over a hydrotreatment catalyst, b) an optional step of separating the effluent obtained from the hydrotreatment step a), c) a step of hydrocracking at least a portion of the effluent obtained from step a) or at least a portion of the heavy fraction obtained from step b), d) a step of separating the effluent
(Continued)

obtained from step c), e) a step of precipitating sediments, f) a step of physical separation of the sediments from the heavy liquid fraction obtained from step e), g) a step of recovering a liquid hydrocarbon fraction having a sediment content, measured using the ISO 10307-2 method, of 0.1% by weight or less.

18 Claims, 1 Drawing Sheet

(51) Int. Cl.

| | |
|---|---|
| ***C10G 47/24*** | (2006.01) |
| ***C10G 49/00*** | (2006.01) |
| ***C10G 65/12*** | (2006.01) |
| ***C10G 67/02*** | (2006.01) |

(52) U.S. Cl.
CPC ..... *C10G 65/12* (2013.01); *C10G 67/02* (2013.01); *C10G 2300/1059* (2013.01); *C10G 2300/202* (2013.01); *C10G 2300/205* (2013.01); *C10G 2300/206* (2013.01)

(58) Field of Classification Search
CPC ..... C10G 49/002; C10G 49/22; C10G 65/00; C10G 67/00; C10G 67/0454
See application file for complete search history.

(56) References Cited

U.S. PATENT DOCUMENTS

| | | | | |
|---|---|---|---|---|
| 3,637,483 | A * | 1/1972 | Carey | C10G 47/00 208/86 |
| 5,980,730 | A * | 11/1999 | Morel | C10G 69/04 208/100 |
| 2011/0266198 | A1* | 11/2011 | Hassan | C10G 21/003 208/390 |
| 2012/0074040 | A1* | 3/2012 | Koseoglu | C10G 27/12 208/97 |
| 2013/0026074 | A1* | 1/2013 | Koseoglu | C10G 31/06 208/309 |

OTHER PUBLICATIONS

PubChem, Hexadecane, <https://pubchem.ncbi.nlm.nih.gov/compound/Hexadecane#section=Color-Form>, accessed on Mar. 4, 2020. (Year: 2020).*

Monument chemical, Advasol HAD heavy aromatic distillate, Safety Data Sheet, Federal Register, vol. 77, No. 58. (Year: 2016).*

Fischer Sci, Aromatic 150 Solvent, Material Safety Data Sheet, <https://fscimage.fischersci.com/msds/91128.htm>, acessed on Mar. 4, 2020. (Year: 2020).*

International Search Report PCT/EP2016/058745 dated Jul. 12, 2016.

* cited by examiner

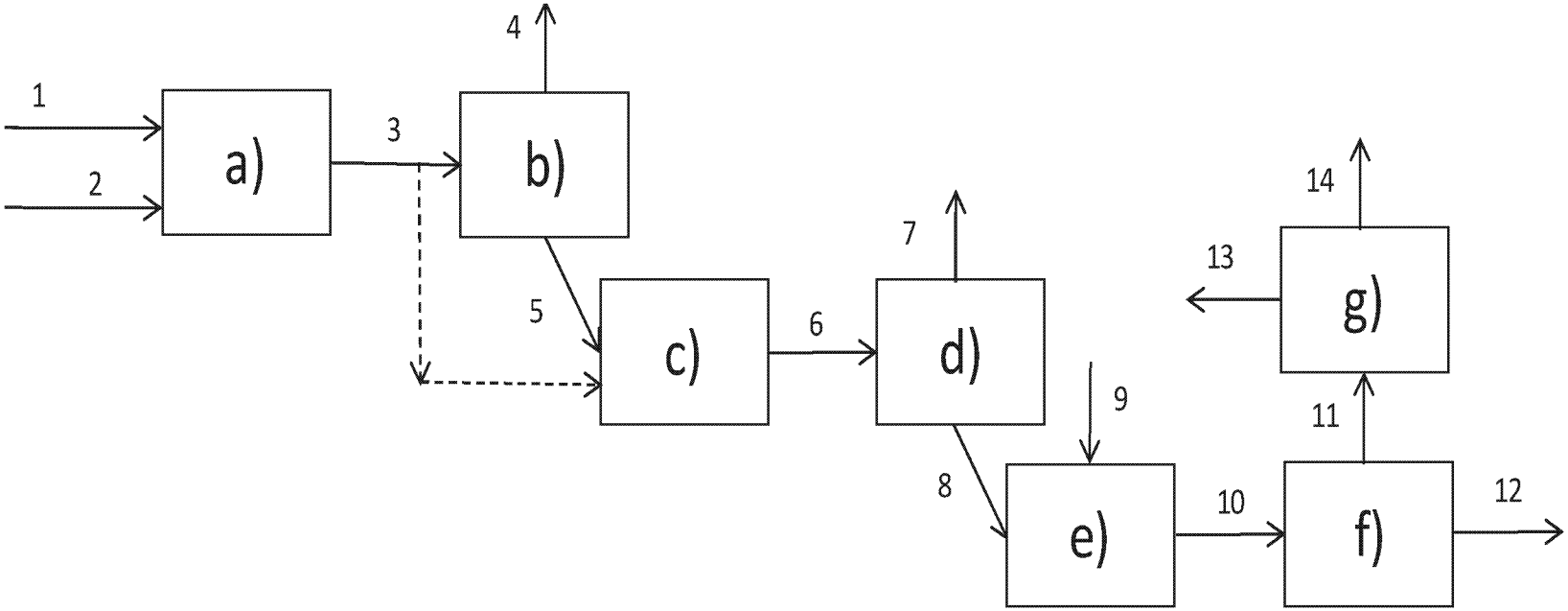
1
2
a)
3
b)
4
5
c)
6
d)
7
8
e)
9
10
f)
11
12
g)
13
14

METHOD FOR CONVERTING FEEDSTOCKS COMPRISING A HYDROTREATMENT STEP, A HYDROCRACKING STEP, A PRECIPITATION STEP AND A SEDIMENT SEPARATION STEP, IN ORDER TO PRODUCE FUEL OILS

The present invention relates to refining and conversion of heavy hydrocarbon fractions containing sulphur-containing impurities, inter alia. More particularly, it relates to a process for the conversion of heavy oil feeds of the atmospheric residue and/or vacuum residue type for the production of heavy fractions for use as fuel oil bases, in particular bunker fuel bases, with a low sediment content. The process of the invention can also be used to produce atmospheric distillates (naphtha, kerosene and diesel), vacuum distillates and light gases (C1 to C4).

The quality requirements for marine fuels are described in ISO standard 8217. The specification concerning sulphur from now on concerns the emissions of $SO_x$ (Annexe VI of the MARPOL convention from the International Maritime Organisation) and is translated as a sulphur content recommendation of 0.5% by weight or less outside the Emission Control Areas (ECA) for 2020-2025, and 0.1% by weight or less within the ECA. Another very restrictive recommendation is the sediment content after aging in accordance with ISO 10307-2 (also known as IP390), which must be 0.1% or less. The sediment content after ageing is a measurement carried out using the method described in ISO standard 10307-2 (also known to the person skilled in the art by the name IP390). Thus, in the remainder of the text, the term "sediment content after aging" should be understood to mean the sediment content measured using the ISO 10307-2 method. The reference to IP390 will also indicate that the measurement of the sediment content after aging is carried out in accordance with the ISO 10307-2 method.

The sediment content in accordance with ISO 10307-1 (also known as IP375) is different from the sediment content after aging in accordance with ISO 10307-2 (also known as IP390). The sediment content after aging in accordance with ISO 10307-2 is a far more restrictive specification and corresponds to the specification which applies to bunker fuels.

According to Annexe VI of the MARPOL convention, a vessel could thus use a sulphur-containing fuel oil as long as the vessel is equipped with a system for treating fumes allowing the oxides of sulphur emissions to be reduced.

Processes for refining and for the conversion of heavy oil feeds comprising a first fixed bed hydrotreatment step then an ebullated bed hydroconversion step have been described in patent documents FR 2 764 300 and EP 0 665 282. EP 0 665 282 describes a process for the hydrotreatment of heavy oils, with the intention of prolonging the service life of the reactors. The process described in FR 2 764 300 describes a process for obtaining fuels (gasoline and diesel) in particular having a low sulphur content. The feeds treated in this process do not contain asphaltenes.

The fuel oils used in maritime transport generally comprise atmospheric distillates, vacuum distillates, atmospheric residues and vacuum residues obtained from straight run processes or from a refining process, in particular hydrotreatment and conversion processes, these cuts possibly being used alone or as a mixture. While they are known to be suitable for heavy feeds charged with impurities, however, these processes produce hydrocarbon fractions comprising catalyst fines and sediments which have to be removed in order to provide a product quality such as that for bunker fuel.

The sediments may be precipitated asphaltenes. Initially in the feed, the conversion conditions and in particular the temperature are such that they undergo reactions (dealkylation, polycondensation etc.), resulting in their precipitation. In addition to existing sediments in the heavy cut at the outlet from the process (measured in accordance with ISO 10307-1, also known as IP375), depending on the conversion conditions, there are also sediments which are qualified as potential sediments which only appear after a physical, chemical and/or heat treatment. The set of sediments including potential sediments is measured in accordance with ISO 10307-1, also known as IP390. These phenomena generally occur when severe conditions are employed, giving rise to high levels of conversion, for example more than 40% or 50% or even higher, and as a function of the nature of the feed.

During the course of its research, the Applicant has developed a novel process integrating a precipitation step and a step of separating the sediments downstream of a fixed bed hydrotreatment step and a hydrocracking step. Surprisingly, it has been discovered that a process of this type can be used to obtain liquid hydrocarbon fractions with a low sediment content after aging (measured using the ISO 10307-2 method), said fractions advantageously being used completely or in part as a fuel oil or as a fuel oil base which complies with future specifications, namely a sediment content after aging of 0.1% by weight or less.

More precisely, the invention concerns a process for the treatment of a hydrocarbon feed containing at least one hydrocarbon fraction having a sulphur content of at least 0.1% by weight, an initial boiling point of at least 340° C. and a final boiling point of at least 440° C., said process comprising the following steps:

a) a fixed bed hydrotreatment step, in which the hydrocarbon feed and hydrogen are brought into contact over a hydrotreatment catalyst;

b) an optional step of separating the effluent obtained from the hydrotreatment step a) into at least one light hydrocarbon fraction containing fuel bases and a heavy fraction containing compounds boiling at at least 350° C., c) a step of hydrocracking at least a portion of the effluent obtained from step a) or at least a portion of the heavy fraction obtained from step b) in at least one ebullated bed reactor containing a supported catalyst, d) a step of separating the effluent obtained from step c) in order to obtain at least one gaseous fraction and at least one heavy liquid fraction, e) a precipitation step, in which the heavy liquid fraction obtained from the separation step d) is brought into contact with a distillate cut wherein at least 20% by weight has a boiling point of 100° C. or more, for a period of less than 500 minutes, at a temperature in the range 25° C. to 350° C., and a pressure of less than 20 MPa, f) a step of physical separation of the sediments from the heavy liquid fraction obtained from the precipitation step e) in order to obtain a liquid hydrocarbon fraction, g) a step of recovering a liquid hydrocarbon fraction having a sediment content, measured in accordance with the ISO 10307-2 method, of 0.1% by weight or less, consisting of separating the liquid hydrocarbon fraction obtained from step f) from the distillate cut introduced during step e).

One of the aims of the present invention is to propose a process for the conversion of heavy oil feeds for the production of fuel oils and fuel oil bases, in particular bunker fuels and bunker fuel bases, with a low sediment content after aging (measured in accordance with the ISO 10307-2 method) of 0.1% by weight or less.

Another aim of the present invention is to jointly produce, by means of the same process, atmospheric distillates (naphtha, kerosene, diesel), vacuum distillates and/or light gases (C1 to C4). The naphtha and diesel type bases may be upgraded in the refinery for the production of fuels for automobiles and for aviation such as, for example, super fuels, jet fuels and diesels.

BRIEF DESCRIPTION OF THE DRAWING

FIG. 1 illustrates a diagrammatic view of the process of the invention which features a hydrotreatment zone, a separation zone, a hydrocracking zone, another separation zone, a precipitation zone, a zone for the physical separation of sediments and a zone for recovering the fraction of interest.

DETAILED DESCRIPTION

The Feed

The feed treated in the process of the invention is advantageously a hydrocarbon feed with an initial boiling point of at least 340° C. and a final boiling point of at least 440° C. Preferably, its initial boiling point is at least 350° C., preferably at least 375° C., and its final boiling point is at least 450° C., preferably at least 460° C., more preferably at least 500° C. and still more preferably at least 600° C.

The hydrocarbon feed of the invention may be selected from atmospheric residues, straight run vacuum residues, crude oils, topped crude oils, deasphalting resins, asphalts or deasphalted pitches, residues obtained from conversion processes, aromatic extracts obtained from production lines for lubricant bases, bituminous sands or their derivatives, oil shales or their derivatives, source rock oils or their derivatives, used alone or as a mixture. In the present invention, the feeds which are treated are preferably atmospheric residues or vacuum residues, or mixtures of these residues.

Advantageously, the feed may contain at least 1% of C7 asphaltenes and at least 5 ppm of metals, preferably at least 2% of C7 asphaltenes and at least 25 ppm of metals.

The hydrocarbon feed treated in the process may contain sulphur-containing impurities, inter alia. The sulphur content may be at least 0.1% by weight, at least 0.5% by weight, preferably at least 1% by weight, more preferably at least 4% by weight, still more preferably at least 5% by weight.

These feeds may advantageously be used as they are. Alternatively, they may be diluted with a co-feed. This co-feed may be a hydrocarbon fraction or a mixture of lighter hydrocarbon fractions which may preferably be selected from products obtained from a fluidized bed catalytic cracking process (FCC, Fluid Catalytic Cracking), a light oil cut (LCO, Light Cycle Oil), a heavy oil cut (HCO, Heavy Cycle Oil), a decanted oil, a FCC residue, a diesel fraction, in particular a fraction obtained by atmospheric distillation or vacuum distillation such as vacuum diesel, or indeed it may derive from another refining process. The co-feed may also advantageously be one or more cuts obtained from the coal liquefaction process or from biomass, aromatic extracts, or any other hydrocarbon cut, or indeed non-oil feeds such as pyrolysis oil. The heavy hydrocarbon feed of the invention may represent at least 50%, preferably 70%, more preferably at least 80%, and still more preferably at least 90% by weight of the total hydrocarbon feed treated in the process of the invention.

The process of the invention is aimed at the production of a liquid hydrocarbon fraction having a sediment content after aging of 0.1% by weight or less.

The process of the invention comprises a first step a) for fixed bed hydrotreatment, an optional step b) for separating effluent obtained from hydrotreatment step a) into a light fraction and a heavy fraction, followed by an ebullated bed step c) for hydrocracking at least a portion of the effluent obtained from step a) or at least a portion of the heavy fraction obtained from step b), a step d) for separating the effluent obtained from step c) in order to obtain at least one gaseous fraction and at least one heavy liquid fraction, a step e) for the precipitation of sediments from the heavy liquid fraction obtained from step d), a step f) for physical separation of the sediments from the heavy liquid fraction obtained in step e), and finally a step g) for recovering a liquid hydrocarbon fraction with a sediment content after aging of 0.1% by weight or less.

The aim of hydrotreatment is both to refine, i.e. substantially reduce the content of metals, sulphur and other impurities, while improving the hydrogen to carbon ratio (H/C), and at the same time to partially transform the hydrocarbon feed to a greater or lesser extent into lighter cuts. The effluent obtained in the fixed bed hydrotreatment step a) may then be sent to the ebullated bed hydrocracking step c), either directly or after having undergone a step of separating the light fractions. Step c) can be used to carry out a partial conversion of the feed in order to produce an effluent primarily comprising catalyst fines and sediments which have to be removed in order to comply with a product quality such as that for bunker fuel. The process of the invention is characterized in that it comprises a step e) for precipitation and a step f) for physical separation of the sediments carried out under conditions that can be used to improve the efficiency of separation of the sediments and thus obtain fuel oils or fuel oil bases with a sediment content after aging of 0.1% by weight or less.

One of the advantages of the concatenation of a fixed bed hydrotreatment then an ebullated bed hydrocracking treatment resides in the fact that the feed for the ebullated bed hydrocracking reactor has already been at least partially hydrotreated. In this manner, it is possible to obtain, for an equivalent conversion, better quality hydrocarbon effluents, in particular with lower sulphur contents. In addition, the consumption of catalyst in the ebullated bed hydrocracking reactor is greatly reduced compared with a process without prior fixed bed hydrotreatment.

Hydrotreatment Step a)

In the process of the present invention, the feed for the invention undergoes a step a) for fixed bed hydrotreatment, in which the feed and hydrogen are brought into contact with a hydrotreatment catalyst.

The term "hydrotreatment", routinely known as HDT, means catalytic treatments with the addition of hydrogen in order to refine hydrocarbon feeds, i.e. substantially reduce the quantity of metals, sulphur and other impurities, while improving the hydrogen-to-carbon ratio of the feed and partially transforming the feed into lighter cuts to a greater or lesser extent. Hydrotreatment in particular includes hydrodesulphurization reactions (routinely known as HDS), hydrodenitrogenation reactions (routinely known as HDN), and hydrodemetallization reactions (routinely known as HDM), accompanied by hydrogenation, hydrodeoxygenation, hydrodearomatization, hydroisomerization, hydrodealkylation, hydrocracking, hydrodeasphalting and Conradson Carbon reduction reactions.

In a preferred variation, the hydrotreatment step a) comprises a first step a1) for hydrodemetallization (HDM) carried out in one or more fixed bed hydrodemetallization zones, and a subsequent second step a2) for hydrodesulphurization (HDS) carried out in one or more fixed bed hydrodesulphurization zones. During said first hydrodemetallization step a1), the feed and hydrogen are brought into contact over a hydrodemetallization catalyst under hydrodemetallization conditions, then during said second step a2) for hydrodesulphurization, the effluent from the first step a1) for hydrodemetallization is brought into contact with a hydrodesulphurization catalyst under hydrodesulphurization conditions. This process, known by the name HYVAHL-F™, is described, for example, in U.S. Pat. No. 5,417,846.

In a variation of the invention, when the feed contains more than 100 ppm, or even more than 200 ppm of metals and/or when the feed comprises impurities such as iron derivatives, it may be advantageous to use permutable reactors ("PRS" technology, i.e. "Permutable Reactor System" technology) as described in patent FR 2 681 871. These permutable reactors are generally fixed bed reactors located upstream of the fixed bed hydrodemetallization section.

The person skilled in the art will readily appreciate that hydrodemetallization reactions are carried out in the hydrodemetallization step, but at the same time, some other hydrotreatment reactions occur, in particular hydrodesulphurization reactions. Similarly, hydrodesulphurization reactions occur in the hydrodesulphurization step, but at the same time, some other hydrotreatment reactions occur, in particular hydrodemetallization. The person skilled in the art will appreciate that the hydrodemetallization step commences where the hydrotreatment step commences, i.e. where the concentration of metals is a maximum. The person skilled in the art will appreciate that the hydrodesulphurization step ends where the hydrotreatment step ends, i.e. where sulphur elimination is the most difficult. Between the hydrodemetallization step and the hydrodesulphurization step, the person skilled in the art will sometimes define a transitional zone in which all of the types of hydrotreatment reactions occur.

The hydrotreatment step a) of the invention is carried out under hydrotreatment conditions. It may advantageously be carried out at a temperature in the range 300° C. to 500° C., preferably in the range 350° C. to 420° C., and under an absolute pressure in the range 5 MPa to 35 MPa, preferably in the range 11 MPa to 20 MPa. The temperature is normally adjusted as a function of the desired level of hydrotreatment and the envisaged treatment duration. Usually, the hourly space velocity of the hydrocarbon feed, normally known as the HSV, which is defined as the volumetric flow rate of feed divided by the total volume of catalyst, may be in the range from 0.1 $h^{-1}$ to 5 $h^{-1}$, preferably 0.1 $h^{-1}$ to 2 $h^{-1}$, and more preferably in the range 0.1 $h^{-1}$ to 0.45 $h^{-1}$. The quantity of hydrogen mixed with the feed may be in the range 100 to 5000 normal cubic metres ($Nm^3$) per cubic metre ($m^3$) of liquid feed, preferably in the range 200 $Nm^3/m^3$ to 2000 $Nm^3/m^3$, and more preferably in the range 300 $Nm^3/m^3$ to 1500 $Nm^3/m^3$. The hydrotreatment step a) may be carried out on an industrial scale in one or more liquid downflow reactors.

The hydrotreatment catalysts used are preferably known catalysts. They may be granular catalysts comprising, on a support, at least one metal or compound of a metal having a hydrodehydrogenating function. These catalysts may advantageously be catalysts comprising at least one metal from group VIII, generally selected from the group constituted by nickel and cobalt, and/or at least one metal from group VIB, preferably molybdenum and/or tungsten. As an example, a catalyst comprising 0.5% to 10% by weight of nickel, preferably 1% to 5% by weight of nickel (expressed as nickel oxide, NiO) and 1% to 30% by weight of molybdenum, preferably 5% to 20% by weight of molybdenum (expressed as molybdenum oxide, $MoO_3$) on a mineral support may be used. This support may, for example, be selected from the group constituted by alumina, silica, silica-aluminas, magnesia, clays and mixtures of at least two of these minerals. Advantageously, this support may include other doping compounds, in particular oxides selected from the group constituted by boron oxide, zirconia, cerine, titanium oxide, phosphoric anhydride and a mixture of these oxides. Usually, an alumina support is used, and more usually an alumina support doped with phosphorus and optionally with boron. When phosphoric anhydride, $P_2O_5$, is present, its concentration is less than 10% by weight. When boron trioxide $B_2O_3$ is present, its concentration is less than 10% by weight. The alumina used may be a γ (gamma) alumina or eta (η) alumina. This catalyst is usually in the form of extrudates. The total quantity of oxides of metals from groups VIB and VIII may be 5% to 40% by weight, in general 7% to 30% by weight, and the weight ratio, expressed as the metallic oxide, between the metal (or metals) from group VIB and the metal (or metals) from group VIII is generally in the range 20 to 1, and usually in the range 10 to 2.

In the case of a hydrotreatment step including a hydrodemetallization step (HDM) then a hydrodesulphurization (HDS) step, specific catalysts which are suitable for each step are preferably used.

Examples of catalysts which may be used in the hydrodemetallization step are indicated in patent documents EP 0 113 297, EP 0 113 284, U.S. Pat. Nos. 5,221,656, 5,827,421, 7,119,045, 5,622,616 and 5,089,463. Preferably, HDM catalysts are used in the permutable reactors.

Examples of catalysts which may be used in the hydrodesulphurization step are those indicated in patent documents EP 0 113 297, EP 0 113 284, U.S. Pat. Nos. 6,589,908, 4,818,743 or 6,332,976.

It is also possible to use a mixed catalyst, which is active for hydrodemetallization and hydrodesulphurization, both in the hydrodemetallization section and in the hydrodesulphurization section, as described in patent document FR 2 940 143.

Prior to injection of the feed, the catalysts used in the process of the present invention preferably undergo an in situ or ex situ sulphurization treatment.

Optional Separation Step b)

The step of separating the effluent obtained from hydrotreatment step a) is optional.

In the case in which the step of separating effluent obtained from hydrotreatment step a) is not carried out, at least a portion of the effluent obtained from hydrotreatment step a) is introduced into the section for carrying out the ebullated bed hydrocracking step c) without changing the chemical composition and without any significant loss of pressure. The term "significant loss of pressure" means a loss of pressure caused by a valve or a decompression turbine, which can be estimated to be a pressure drop of more than 10% of the total pressure. The person skilled in the art will generally use these pressure drops or decompressions during the separation steps.

When the separation step is carried out on the effluent obtained from hydrotreatment step a), it is optionally completed by other supplemental separation steps, in order to separate at least one light fraction and at least one heavy fraction.

The term "light fraction" means a fraction in which at least 90% of the compounds have a boiling point of less than 350° C.

The term "heavy fraction" means a fraction in which at least 90% of the compounds have a boiling point of 350° C. or more. Preferably, the light fraction obtained during separation step b) comprises a gas phase and at least one light naphtha, kerosene and/or diesel type hydrocarbon fraction. The heavy fraction preferably comprises a vacuum distillate fraction and a vacuum residue fraction and/or an atmospheric residue fraction.

Separation step b) may be carried out using any method which is known to the person skilled in the art. This method may be selected from high or low pressure separation, high or low pressure distillation, high or low pressure stripping, and combinations of these various methods which may be operated at different pressures and temperatures.

In accordance with a first embodiment of the present invention, the effluent obtained from hydrotreatment step a) undergoes a separation step b) with decompression. In this embodiment, the separation is preferably carried out in a fractionation section which may initially comprise a high pressure high temperature (HPHT) separator and optionally a high pressure low temperature (HPLT) separator, optionally followed by an atmospheric distillation section and/or a vacuum distillation section. The effluent from step a) may be sent to a fractionation section, generally to a HPHT separator, in order to obtain a light fraction and a heavy fraction mainly containing compounds boiling at at least 350° C. In general, the separation is preferably not carried out at a precise cut point, but rather it resembles an instantaneous, flash, separation. The cut point for separation is advantageously in the range 200° C. to 400° C.

Preferably, said heavy fraction may then be fractionated, by atmospheric distillation, into at least one atmospheric distillate fraction preferably containing at least one light naphtha, kerosene and/or diesel type hydrocarbon fraction, and an atmospheric residue fraction. At least a portion of the atmospheric residue fraction may also be fractionated by vacuum distillation into a vacuum distillate fraction, preferably containing vacuum diesel, and a vacuum residue fraction. At least a portion of the vacuum residue fraction and/or the atmospheric residue fraction are advantageously sent to the hydrocracking step c). A portion of the vacuum residue fraction and/or the atmospheric residue fraction may also be used directly as a fuel oil base, in particular as a fuel oil base with a low sulphur content. A portion of the vacuum residue fraction and/or the atmospheric residue fraction may also be sent to another conversion process, in particular a fluidized bed catalytic cracking process.

In accordance with a second embodiment, the effluent obtained from the hydrotreatment step a) undergoes a step b) for separation without decompression. In this embodiment, the effluent from hydrotreatment step a) is sent to a fractionation section, generally to a HPHT separator, with a cut point in the range 200° C. to 450° C., in order to obtain at least one light fraction and at least one heavy fraction. In general, the separation is preferably not carried out using a precise cut point, but rather it resembles an instantaneous, flash, type separation. The heavy fraction may then be sent directly to the hydrocracking step c).

The light fraction then undergoes other separation steps. Advantageously, it may undergo an atmospheric distillation in order to obtain a gas fraction, at least one light liquid hydrocarbon fraction of the naphtha, kerosene and/or diesel type and a vacuum distillate fraction, the latter possibly being sent at least in part to the hydrocracking step c). Another portion of the vacuum distillate may be used as a flux for a fuel oil. Another portion of the vacuum distillate may be upgraded by undergoing a step of fluidized bed hydrocracking and/or catalytic cracking.

Separation without decompression means that the thermal integration is better, resulting in savings in energy and equipment. Furthermore, this embodiment has technico-economic advantages given that it is not necessary to increase the pressure of the streams after separation before the subsequent hydrocracking step. Intermediate fractionation without decompression is simpler than fractionation with decompression, and so the investment costs are also advantageously reduced.

The gas fractions obtained from the separation step preferably undergo a purification treatment in order to recover hydrogen and to recycle it to the hydrotreatment and/or hydrocracking reactors, or even to the precipitation step. The presence of the separation step between the hydrotreatment step a) and the hydrocracking step c) advantageously means that two independent hydrogen circuits are available, one connected to the hydrotreatment step, the other to the hydrocracking step, and which, depending on requirements, may be connected to one or the other. The hydrogen may be added to the hydrotreatment section or to the hydrocracking section or to both. The recycled hydrogen may supply the hydrotreatment section or the hydrocracking section, or both. One compressor may optionally be common to the two hydrogen circuits. The fact of being able to connect the two hydrogen circuits means that hydrogen management can be optimized and investments in terms of compressors and/or gaseous effluent purification units can be limited. The various implementations for hydrogen management which may be used in the present invention are described in patent application FR 2 957 607.

The light fraction obtained at the end of the separation step b) which comprises naphtha, kerosene and/or diesel type hydrocarbons or others, in particular LPG and vacuum diesel, may be upgraded using methods which are well known to the person skilled in the art. The products obtained may be integrated into the fuel formulations (also known as fuel "pools"), or may undergo supplemental refining steps. The naphtha, kerosene, diesel and vacuum diesel fraction(s) may undergo one or more treatments, for example hydrotreatment, hydrocracking, alkylation, isomerization, catalytic reforming, catalytic or thermal cracking, in order to bring them, separately or as a mixture, up to the required specifications which may concern the sulphur content, the smoke point, the octane number, the cetane number, and others.

The light fraction obtained at the end of step b) may be used at least on part to form the distillate cut of the invention used in step e) for precipitation of the sediments, or for mixing with said distillate cut of the invention.

A portion of the heavy fraction obtained from separation step b) may be used to form the distillate cut of the invention used in sediment precipitation step e).

Ebullated Bed Hydrocracking Step c)

In accordance with the process of the present invention, at least a portion of the effluent obtained from hydrotreatment step a) or at least a portion of the heavy fraction obtained from step b) is sent to a hydrocracking step c) which is carried out in at least one reactor, advantageously two reactors, containing at least one supported ebullated bed catalyst. Said reactor may function in upflow liquid and gas mode. The principal aim of hydrocracking is to convert the heavy hydrocarbon feed into lighter cuts while carrying out partial refining.

In accordance with one embodiment of the present invention, a portion of the initial hydrocarbon feed may be injected directly into the inlet to the ebullated bed hydrocracking step c) as a mixture with the effluent from the fixed bed hydrotreatment step a) or the heavy fraction obtained from step b), without this portion of the hydrocarbon feed having been treated in the fixed bed hydrotreatment section. This embodiment may belong to a partial short circuit of the fixed bed hydrotreatment section a).

In accordance with a variation, a co-feed may be introduced into the inlet to the ebullated bed hydrocracking step c) with the effluent from the fixed bed hydrotreatment section a) or the heavy fraction obtained from step b). This co-feed may be selected from atmospheric residues, straight run vacuum residues, deasphalted oils, aromatic extracts obtained from lubricant base production lines, hydrocarbon fractions or a mixture of hydrocarbon fractions which may be selected from products obtained from a fluidized bed catalytic cracking process, in particular a light cycle oil (LCO), a heavy cycle oil (HCO), a decanted oil, or from distillation, from gas oil fractions in particular those obtained by atmospheric distillation or vacuum distillation such as, for example, vacuum diesel. In accordance with another variation and in the case in which the hydrocracking section has several ebullated bed reactors, part or all of this co-feed may be injected into one of the reactors downstream of the first reactor.

The hydrogen necessary to the hydrocracking reaction may already be present in a sufficient quantity in the effluent obtained from the hydrotreatment step a) injected into the inlet to the ebullated bed hydrocracking section c). However, it is preferable to provide for supplemental addition of hydrogen into the inlet of the hydrocracking section c). In the case in which the hydrocracking section has a plurality of ebullated bed reactors, hydrogen may be injected into the inlet to each reactor. The injected hydrogen may be a makeup stream and/or a recycle stream.

Ebullated bed technology is well known to the person skilled in the art. Only the principal operating conditions will be described here. Ebullated bed technologies conventionally use supported catalysts in the form of extrudates with a diameter which is generally of the order of 1 millimetre or less. The catalysts remain inside the reactors and are not evacuated with the products except during the phases for makeup and withdrawal of catalysts which are necessary in order to maintain the catalytic activity. The temperature levels may be high in order to obtain high conversions while minimizing the quantities of catalysts employed. The catalytic activity may be kept constant by replacing the catalyst in-line. Thus, it is not necessary to stop the unit in order to change spent catalyst, nor to increase the reaction temperatures as the cycle progresses in order to compensate for deactivation. In addition, the fact of working under constant operating conditions has the advantage of obtaining yields and qualities of products which are constant throughout the cycle. In addition, because the catalyst is kept stirred by a substantial recycle of liquid, the pressure drop over the reactor remains small and constant. Because of the wear of the catalysts in the reactors, the products leaving the reactors may contain fine particles of catalyst.

The conditions for the ebullated bed hydrocracking step c) may be conventional conditions for ebullated bed hydrocracking of a hydrocarbon feed. It may be operated at an absolute pressure in the range 2.5 MPa to 35 MPa, preferably in the range 5 MPa to 25 MPa, more preferably in the range 6 MPa to 20 MPa, and still more preferably in the range 11 MPa to 20 MPa, at a temperature in the range 330° C. to 550° C., preferably in the range 350° C. to 500° C. The hourly space velocity (HSV) and the partial pressure of hydrogen are parameters which are fixed as a function of the characteristics of the product to be treated and the desired conversion. The HSV, which is defined as the volumetric flow rate of the feed divided by the total volume of the reactor, is generally in the range 0.1 $h^{-1}$ to 10 $h^{-1}$, preferably in the range 0.1 $h^{-1}$ to 5 $h^{-1}$ and more preferably in the range 0.1 $h^{-1}$ to 1 $h^{-1}$. The quantity of hydrogen mixed with the feed is usually 50 to 5000 normal cubic metres ($Nm^3$) per cubic metre ($m^3$) of liquid feed, usually 100 $Nm^3/m^3$ to 1500 $Nm^3/m^3$ and preferably 200 $Nm^3/m^3$ to 1200 $Nm^3/m^3$.

It is possible to use a conventional granular hydrocracking catalyst comprising at least one metal or compound of a metal having a hydrodehydrogenating function on an amorphous support. This catalyst may be a catalyst comprising metals from group VIII, for example nickel and/or cobalt, usually in association with at least one metal from group VIB, for example molybdenum and/or tungsten. As an example, it is possible to use a catalyst comprising 0.5% to 10% by weight of nickel, preferably 1% to 5% by weight of nickel (expressed as nickel oxide, NiO) and 1% to 30% by weight of molybdenum, preferably 5% to 20% by weight of molybdenum (expressed as molybdenum oxide, $MoO_3$) on an amorphous mineral support. This support may, for example, be selected from the group constituted by alumina, silica, silica-aluminas, magnesia, clays and mixtures of at least two of these minerals. This support may also include other compounds, for example oxides selected from the group constituted by boron oxide, zirconia, titanium oxide and phosphoric anhydride. Usually, an alumina support is used, and more usually an alumina support doped with phosphorus and optionally with boron. When phosphoric anhydride, $P_2O_5$, is present, its concentration is normally less than 20% by weight and more usually less than 10% by weight. When boron trioxide, $B_2O_3$, is present, its concentration is usually less than 10% by weight. The alumina used is usually a $\gamma$ (gamma) alumina or $\eta$ (eta) alumina. This catalyst may be in the form of extrudates. The total quantity of oxides of metals from groups VI and VIII may be in the range 5% to 40% by weight, preferably in the range 7% to 30% by weight, and the weight ratio, expressed as the metallic oxide, between the metal (or metals) from group VI and the metal (or metals) from group VIII is in the range 20 to 1, preferably in the range 10 to 2.

The spent catalyst may be partially replaced with fresh catalyst, generally by withdrawal from the bottom of the reactor, and by introducing fresh or new catalyst into the top of the reactor at regular intervals, i.e., for example, in bursts or continuously or quasi-continuously. It is also possible to introduce the catalyst via the bottom of the reactor and to withdraw it via the top. As an example, it is possible to introduce fresh catalyst every day. The rate of replacement of spent catalyst with fresh catalyst may, for example, be approximately 0.05 kilograms to approximately 10 kilograms per cubic metre of feed. This withdrawal and replacement are carried out with the aid of devices allowing for continuous operation of this hydrocracking step. The hydrocracking reactor usually comprises a recirculation pump for maintaining the catalyst as an ebullated bed by continuously recycling at least a portion of the liquid withdrawn from the head of the reactor and re-injecting it into the bottom of the reactor. It is also possible to send the spent catalyst from the reactor to a regeneration zone in which the carbon and sulphur it contains are eliminated before re-injecting it into the hydrocracking step b).

The hydrocracking step c) of the process of the invention may be carried out under the conditions of the H-OIL® process as described, for example, in U.S. Pat. No. 6,270,654.

Ebullated bed hydrocracking may be carried out in a single reactor or in a plurality of reactors, preferably two, disposed in series. The fact of using at least two ebullated bed reactors in series means that better quality products can be obtained in a better yield. In addition, hydrocracking in two reactors means that the operability as regards the flexibility of the operating conditions and of the catalytic system can be improved. Preferably, the temperature of the second ebullated bed reactor is at least 5° C. higher than that of the first ebullated bed reactor. The pressure of the second reactor may be 0.1 MPa to 1 MPa lower than that for the first reactor in order to allow at least a portion of the effluent obtained from the first step to flow without requiring pumping. The various operating conditions in terms of temperature in the two hydrocracking reactors are selected in order to be able to control the hydrogenation and the conversion of the feed into the desired products in each reactor.

In the case in which the hydrocracking step c) is carried out in two sub-steps c1) and c2) in two reactors disposed in series, the effluent obtained at the end of the first sub-step c1) may optionally undergo a step of separation of the light fraction and the heavy fraction, and at least a portion, preferably all of said heavy fraction may be treated in the second hydrocracking sub-step c2). This separation is advantageously carried out in an inter-stage separator such as that described, for example, in U.S. Pat. No. 6,270,654, and can in particular be used to avoid over-cracking of the light fraction in the second hydrocracking reactor. It is also possible to transfer all or a portion of the spent catalyst withdrawn from the reactor for the first sub-step b1) for hydrocracking, operating at a lower temperature, directly to the reactor for the second sub-step b2), operating at a higher temperature, or to transfer all or a portion of the spent catalyst withdrawn from the reactor for the second sub-step b2) directly to the reactor for the first sub-step b1). This cascade system is described, for example, in U.S. Pat. No. 4,816,841.

The hydrocracking step may also be carried out with a plurality of reactors in parallel (generally two) in the case of large capacities. The hydrocracking step may thus comprise a plurality of stages in series, optionally separated by an inter-stage separator, each stage being constituted by one or more reactors in parallel.

Step d) for Separating the Hydrocracking Effluent

The process of the invention may also comprise a separation step d) in order to obtain at least one gaseous fraction and at least one heavy liquid fraction.

The effluent obtained at the end of hydrocracking step c) comprises a liquid fraction and a gaseous fraction containing gases, in particular $H_2$, $H_2S$, $NH_3$ and C1-C4 hydrocarbons. This gaseous fraction may be separated from the effluent with the aid of separation devices which are well known to the person skilled in the art, in particular with the aid of one or more separator drums which may be operated at different pressures and temperatures, optionally associated with a steam or hydrogen stripping means and with one or more distillation columns. The effluent obtained at the end of the hydrocracking step c) is advantageously separated in at least one separator drum into at least one gaseous fraction and at least one heavy liquid fraction. These separators may, for example, be high pressure high temperature (HPHT) separators and/or high pressure low temperature (HPLT) separators.

After optional cooling, this gaseous fraction is preferably treated in a hydrogen purification means in order to recover hydrogen which has not been consumed during the hydrotreatment and hydrocracking reactions. The hydrogen purification means may be an amine scrubber, a membrane, a PSA type system, or a plurality of these means in series. The purified hydrogen may then advantageously be recycled to the process of the invention, after optional recompression. The hydrogen may be introduced into the inlet to the hydrotreatment step a) and/or to various regions during the hydrotreatment step a) and/or to the inlet to the hydrocracking step c) and/or to various regions during the hydrocracking step c), or even into the precipitation step.

Separation step d) may also comprise an atmospheric distillation and/or vacuum distillation step. Advantageously, the separation step d) also comprises at least one atmospheric distillation step in which the liquid hydrocarbon fraction(s) obtained after separation is (are) fractionated by atmospheric distillation into at least one atmospheric distillation fraction and at least one atmospheric residue fraction. The atmospheric distillate fraction may contain fuel bases (naphtha, kerosene and/or diesel) which can be commercially upgraded, for example in the refinery for the production of automobile and aviation fuels.

Furthermore, separation step d) of the process of the invention may advantageously further comprise at least one vacuum distillation step in which the liquid hydrocarbon fraction(s) obtained after separation and/or the atmospheric residue fraction obtained after atmospheric distillation is (are) fractionated by vacuum distillation into at least one vacuum distillate and at least one vacuum residue. Preferably, the separation step d) initially comprises an atmospheric distillation, in which the liquid hydrocarbon fraction(s) obtained after separation is (are) fractionated by atmospheric distillation into at least one atmospheric distillate fraction and at least one atmospheric residue fraction, then a vacuum distillation in which the atmospheric residue fraction obtained after atmospheric distillation is fractionated by vacuum distillation into at least one vacuum distillate fraction and at least one vacuum residue fraction. The vacuum distillate fraction typically contains vacuum diesel type fractions.

At least a portion of the vacuum residue fraction may be recycled to hydrocracking step c).

A portion of the heavy liquid fraction obtained from separation step d) may be used to form the distillate cut in accordance with the invention in sediment precipitation step e).

Step e): Precipitation of Sediments

The heavy liquid fraction obtained at the end of separation step d) contains organic sediments which result from the conditions for hydrotreatment and hydrocracking and from catalyst residues. A portion of the sediments is constituted by asphaltenes precipitated under the hydrotreatment and hydrocracking conditions, and are analysed as "existing sediments" (IP375).

The quantity of sediments in the heavy liquid fraction varies as a function of the hydrocracking conditions. From the point of view of analysis, existing sediments (IP375) are distinguished from sediments after aging (IP390), which includes potential sediments. However, intense hydrocracking conditions, i.e. when the rate of conversion is more than 40% or 50%, for example, cause the formation of existing sediments and potential sediments.

In order to obtain a fuel oil or a fuel oil base which complies with the recommendations for a sediment content after aging (measured using the ISO 10307-2 method) of 0.1% or less, the process of the invention comprises a step of precipitation which can be used to improve the sediment separation efficiency and thus to obtain stable fuel oils or fuel oil bases, i.e. with a sediment content after aging of 0.1% by weight or less.

The precipitation step in the process of the invention comprises bringing the heavy liquid fraction obtained from separation step d) into contact with a distillate cut at least 20% by weight of which has a boiling point of 100° C. or higher, preferably 120° C. or higher, more preferably 150° C. or higher. In a variation of the invention, the distillate cut is characterized in that it comprises at least 25% by weight with a boiling point of 100° C. or higher, preferably 120° C. or higher, more preferably 150° C. or higher.

Advantageously, at least 5% by weight, or even 10% by weight of the distillate cut of the invention has a boiling point of at least 252° C.

More advantageously, at least 5% by weight, or even 10% by weight of the distillate cut of the invention has a boiling point of at least 255° C.

A portion or even all of said distillate cut may originate from separation steps b) and/or d) of the invention or from another refining process, or indeed from another chemical process.

Using the distillate cut in accordance with the invention also has the advantage of dispensing with using a lot of high added value cuts such as petrochemical cuts, naphtha cuts, etc.

The distillate cut of the invention advantageously comprises hydrocarbons containing more than 12 carbon atoms, preferably hydrocarbons containing more than 13 carbon atoms, more preferably hydrocarbons containing in the range 13 to 40 carbon atoms.

The distillate cut may be used as a mixture with a naphtha type cut and/or a vacuum diesel type cut and/or a vacuum residue type cut. Said distillate cut may be used as a mixture with the light fraction obtained from step b), the heavy fraction obtained from step b), or the liquid heavy fraction obtained from step d), these fractions possibly being used alone or as a mixture. In the case in which the distillate cut of the invention is mixed with another cut, a light fraction and/or a heavy fraction such as that indicated above, the proportions are selected in a manner such that the resulting mixture satisfies the characteristics of the distillate cut of the invention.

The precipitation step e) of the invention can be used to obtain all of the existing and potential sediments (by converting the potential sediments into existing sediments) in a manner such as to separate them efficiently and thus reach the maximum of 0.1% by weight sediment content after aging (measured in accordance with the ISO 10307-2 method).

The precipitation step e) in accordance with the invention is advantageously carried out with a dwell time of less than 500 minutes, preferably less than 300 minutes, more preferably less than 60 minutes, at a temperature in the range 25° C. to 350° C., preferably in the range 50° C. to 350° C., preferably in the range 65° C. to 300° C. and more preferably in the range 80° C. to 250° C. The pressure of the precipitation step is advantageously less than 20 MPa, preferably less than 10 MPa, more preferably less than 3 MPa and still more preferably less than 1.5 MPa. The weight ratio between the distillate cut of the invention and the heavy fraction obtained from separation step d) is in the range 0.01 to 100, preferably in the range 0.05 to 10, more preferably in the range 0.1 to 5, and still more preferably in the range 0.1 to 2. When the distillate cut of the invention is withdrawn from the process, it is possible to accumulate this cut over a start-up period so as to obtain the desired ratio.

The distillate cut of the invention may also originate in part from step g) for recovering the liquid hydrocarbon fraction.

The precipitation step e) may be carried out with the aid of a variety of equipment. A static mixer or a stirred tank may optionally be used in a manner such as to promote efficient contact between the heavy liquid fraction obtained at the end of the separation step d) and the distillate cut of the invention. One or more exchangers may be used before or after mixing the heavy liquid fraction obtained at the end of step d) and the distillate cut of the invention in order to reach the desired temperature. One or more vessels may be used in series or in parallel, such as a horizontal or vertical drum, optionally with a decanting function in order to eliminate a portion of the heaviest solids. A stirred tank which may optionally be equipped with a jacket to regulate the temperature may also be used. This tank may be provided with a bottom outlet in order to eliminate a portion of the heaviest solids.

Advantageously, precipitation step e) is carried out in the presence of an inert gas and/or an oxidizing gas and/or a liquid oxidizing agent and/or hydrogen, preferably obtained from the process of the invention, in particular separation steps b) and/or c).

Sediment precipitation step e) may be carried out in the presence of an inert gas such as dinitrogen, or in the presence of an oxidizing gas such as dioxygen, ozone or oxides of nitrogen, or in the presence of a mixture containing an inert gas and an oxidizing gas such as air or nitrogen-depleted air. The advantage of using an oxidizing gas is that the precipitation process is accelerated.

Sediment precipitation step e) may be carried out in the presence of a liquid oxidizing agent that can be used to accelerate the precipitation process. The term "liquid oxidizing agent" means an oxygen-containing compound, for example a peroxide such as hydrogen peroxide, or indeed a mineral oxidizing agent such as a solution of potassium permanganate or a mineral acid such as sulphuric acid. In accordance with this variation, the liquid oxidizing agent is thus mixed with the heavy liquid fraction obtained from separation step d) and the distillate cut of the invention when carrying out step e) for precipitation of the sediments.

At the end of step e), a hydrocarbon fraction is obtained with an enriched content of existing sediments at least partially mixed with the distillate cut in accordance with the invention. This mixture is sent to step f) for physical separation of the sediments.

Step f): Separation of Sediments

The process of the invention further comprises a step f) for physical separation of the sediments and catalyst fines in order to obtain a liquid hydrocarbon fraction.

The heavy liquid fraction obtained from precipitation step e) contains precipitated organic sediments of the asphaltene type which are a result of the hydrocracking conditions and the precipitation conditions of the invention. This heavy liquid fraction may also contain catalyst fines obtained as the result of attrition of the extrudate type catalysts during operation of the hydrocracking reactor.

Thus, at least a portion of the heavy liquid fraction obtained from precipitation step e) undergoes a separation of the sediments and catalyst residues by means of a physical separation means selected from a filter, a separation membrane, a bed of organic or inorganic type filtration solids, an electrostatic precipitation, an electrostatic filter, a centrifugation system, decanting, a centrifugal decanter, endless screw extraction or physical extraction. A combination, in series and/or in parallel, which may function in a sequential manner, of a plurality of separation means of the same or different types may be used during this step f) for separation of the sediments and catalyst residues. One of these solid-liquid separation techniques may necessitate the periodical use of a light flushing fraction which may or may not be obtained from the process which, for example, can be used to clean a filter and evacuate the sediments.

A liquid hydrocarbon fraction is obtained from the sediment separation step f) (with a sediment content after aging of 0.1% by weight or less) comprising a portion of the distillate cut of the invention introduced during step e).

Step g): Recovery of the Liquid Hydrocarbon Fraction

In accordance with the invention, the mixture obtained from step f) is advantageously introduced into a step g) for recovering the liquid hydrocarbon fraction having a sediment content after aging of 0.1% by weight or less, consisting of separating the liquid hydrocarbon fraction obtained in step f) from the distillate cut introduced during step e). Step g) is a separation step which is similar to separation steps b) and d). Step g) may be carried out using separator drum and/or distillation column type equipment in order to separate on the one hand, at least a portion of the distillate cut introduced during step e) and on the other hand, the liquid hydrocarbon fraction with a sediment content after aging of 0.1% by weight or less.

Advantageously, a portion of the distillate cut separated from step g) is recycled to the precipitation step e).

Said liquid hydrocarbon fraction may advantageously act as a fuel oil base or as a fuel oil, in particular as a bunker fuel base or as a bunker fuel, with a sediment content after aging of less than 0.1% by weight. Advantageously, said liquid hydrocarbon fraction is mixed with one or more fluxing bases selected from the group constituted by light cycle oils from catalytic cracking, heavy cycle oils from catalytic cracking, catalytic cracking residue, a kerosene, a diesel, a vacuum distillate and/or a decanted oil, and the distillate cut in accordance with the invention.

In accordance with a particular embodiment, a portion of the distillate cut of the invention may be left in the liquid hydrocarbon fraction with a reduced sediment content in a manner such that the viscosity of the mixture is directly that of a desired grade of fuel oil, for example 180 or 380 cSt at 50° C.

Fluxing

The liquid hydrocarbon fractions in accordance with the invention may advantageously, at least in part, be used as fuel oil bases or as fuel oil, in particular as a bunker fuel base or as bunker fuel with a sediment content after aging (measured in accordance with the ISO 10307-2 method) of 0.1% by weight or less.

The term "fuel oil" as used in the invention means a hydrocarbon fraction which can be used as a fuel. The term "fuel oil base" as used in the invention means a hydrocarbon fraction which constitutes a fuel oil when mixed with other bases.

In order to obtain a fuel oil, the liquid hydrocarbon fractions obtained from step f) or g) may be mixed with one or more fluxing bases selected from the group constituted by light cycle oils from catalytic cracking, heavy cycle oils from catalytic cracking, catalytic cracking residue, a kerosene, a gas oil, a vacuum distillate and/or a decanted oil, and the distillate cut in accordance with the invention. Preferably, a kerosene, a gas oil and/or a vacuum distillate produced in the process of the invention is used.

Optionally, a portion of the fluxing agents may be introduced as part or all of the distillate cut in accordance with the invention.

Description of FIG. 1

FIG. 1 diagrammatically shows an exemplary implementation of the invention without in any way limiting its scope.

The hydrocarbon feed 1 and hydrogen 2 are brought into contact in a fixed bed hydrotreatment zone (step a)). The effluent 3 obtained from the hydrotreatment zone is sent to a separation zone (optional separation step b)) in order to obtain a light hydrocarbon fraction 4 and a heavy fraction 5 containing compounds boiling at at least 350° C. The effluent 3 obtained from the hydrotreatment zone, in particular in the absence of the optional step b), or a heavy fraction 5 obtained from the separation zone b) (when step b) is carried out) is sent to the ebullated bed hydrocracking zone c). The effluent 6 obtained from the hydrocracking zone c) is sent to a separation zone d) in order to obtain at least one gaseous fraction 7 and at least one heavy liquid fraction 8. This liquid fraction 8 is brought into contact with the distillate cut 9 of the invention during a precipitation step e) in the precipitation zone e). The effluent 10 is constituted by a heavy fraction and sediments and is treated in a physical separation zone f) in order to eliminate a fraction comprising sediments 12 and to recover a liquid hydrocarbon fraction 11 with a reduced sediment content. The liquid hydrocarbon fraction 11 is then treated in a zone g) for recovering, on the one hand, the liquid hydrocarbon fraction 14 with a sediment content after aging of 0.1% by weight or less, and on the other hand a fraction 13 containing at least a portion of the distillate cut introduced into zone e) during step e).

A number of variations as indicated in the description may be used in accordance with the invention. Some variations are described below. In one variation, the separation zone b) between the fixed bed hydrotreatment zone a) and the ebullated bed hydrocracking zone c) is operated without decompression. In another variation, the separation zone b) between the fixed bed hydrotreatment zone a) and the ebullated bed hydrocracking zone c) is operated without decompression. It is also possible for at least a portion of the effluent obtained from the hydrotreatment zone a) to be directly introduced into the ebullated bed hydrocracking zone c) without changing the chemical composition and without significant pressure drops, i.e. without decompression.

Example

The following example illustrates the invention without in any way limiting its scope. A vacuum residue (RSV Oural) was treated; it contained 87.0% by weight of compounds boiling at a temperature of more than 520° C., with a density of 9.5° API and a sulphur content of 2.72% by weight.

The feed underwent a hydrotreatment step including two permutable reactors. The three NiCoMo on alumina catalysts used in series are sold by Axens under the references HF858 (hydrodemetallization catalyst: HDM), HM848 (transition catalyst) and HT438 (hydrodesulphurization catalyst: HDS). The operating conditions are shown in Table 1.

TABLE 1

| Operating conditions, fixed bed hydrotreatment | |
|---|---|
| HDM catalysts, transition and HDS | NiCoMo on alumina |
| Temperature (° C.) | 370 |
| Partial pressure of $H_2$ (MPa) | 15 |
| HSV ($h^{-1}$, $Sm^3$/h fresh feed/$m^3$ of fixed bed catalyst) | 0.18 |
| $H_2$/HC at inlet to fixed bed section without $H_2$ consumption ($Nm^3/m^3$ of fresh feed) | 1000 |

The hydrotreatment effluent then underwent a separation step in order to recover a light fraction (gas) and a heavy fraction containing a majority of compounds boiling at more than 350° C. (350° C.+ fraction).

The heavy fraction (350° C.+ fraction) was then treated in a hydrocracking step comprising two successive ebullated bed reactors. The operating conditions for the hydrocracking step are given in Table 2.

TABLE 2

| Operating conditions for hydrocracking section | |
|---|---|
| Catalysts | 2 ebullated beds NiMo on alumina |
| Temperature R1 (° C.) | 423 |
| Temperature R2 (° C.) | 431 |
| Partial pressure of $H_2$ (MPa) | 13.5 |
| HSV "reactors" ($h^{-1}$, $Sm^3$/h fresh feed/$m^3$ of reactors) | 0.3 |
| HSV "ebullated bed catalysts " ($h^{-1}$, $Sm^3$/h fresh feed/$m^3$ of ebullated bed catalysts) | 0.6 |
| H2/HC, inlet hydrocracking section without $H_2$ consumption ($Nm^3/m^3$ of fresh feed) | 600 |

The NiMo on alumina catalyst used is sold by Axens under reference HOC-548.

The effluent from the hydrocracking step then underwent a separation step in order to separate a gaseous fraction and a heavy liquid fraction using separators. The heavy liquid fraction was then distilled in an atmospheric distillation column in order to recover the distillates and an atmospheric residue.

Sampling, weighing and analysis steps were used to establish an overall material balance for the fixed bed hydrotreatment+ebullated bed hydrocracking concatenation.

The yields and sulphur contents for each fraction obtained in the effluents leaving the general concatenations are given in Table 3 below:

TABLE 3

| Yield (Y) and sulphur content (S) of effluent from hydrocracking section (% by weight/feed) | | |
|---|---|---|
| | Fixed bed hydrotreatment + separation + 2 ebullated bed hydrocracking (423/431° C.) | |
| Products | Y (wt %) | S (wt %) |
| $NH_3$ | 0.7 | 0 |
| $H_2S$ | 2.7 | 94.12 |
| C1-C4 gas) | 4.0 | 0 |
| Naphtha, light (IP-100° C.) | 1.9 | 0.01 |
| Naphtha, heavy (100-150° C.) | 7.4 | 0.02 |

TABLE 3-continued

| Yield (Y) and sulphur content (S) of effluent from hydrocracking section (% by weight/feed) | | |
|---|---|---|
| | Fixed bed hydrotreatment + separation + 2 ebullated bed hydrocracking (423/431° C.) | |
| Products | Y (wt %) | S (wt %) |
| Kerosene (150° C.-225° C.) | 9.2 | 0.03 |
| Diesel (225° C.-350° C.) | 15.4 | 0.05 |
| Vacuum distillate (350° C.-520° C.) | 31.5 | 0.28 |
| Vacuum residue (520° C.+) | 29.3 | 0.47 |

The atmospheric residue AR (350° C.+ cut, i.e. the sum of the vacuum distillate and the vacuum residue) underwent a treatment in accordance with several variations:

A) a variation A (not in accordance with the invention), in which the atmospheric residue AR was filtered using a metallic porous filter with the trade name Pall®. The sediment content after aging was measured on the atmospheric residue recovered after separation of the sediments.

B) a variation B, in which a precipitation step (in accordance with the invention) is carried out by mixing, with stirring at 80° C. for 1 minute, the atmospheric residue AR and a distillate cut in accordance with the invention in the various proportions described in Table 5:

mixture 1: mixture of 50% by weight of atmospheric residue (AR) and 50% by weight of distillate cut X, mixture 2: mixture of 50% by weight of atmospheric residue (AR) and 50% by weight of distillate cut Y, mixture 3: mixture of 50% by weight of atmospheric residue (AR) and 50% by weight of distillate cut Z.

The atmospheric residue which corresponds to the 350° C.+ fraction of the effluent from the hydrocracking step was characterized by a sediment content (IP375) of 0.3% m/m and a sediment content after aging (IP390) of 0.7% m/m.

The simulated distillation curves for the distillate cuts X, Y and Z in the mixtures 1, 2 and 3 are presented in Table 4.

TABLE 4

| Simulated distillation curves for distillate cuts X, Y and Z | | | | | |
|---|---|---|---|---|---|
| Distillate cut X | | Distillate cut Y | | Distillate cut Z | |
| Distilled weight % | Temperature (° C.) | Distilled weight % | Temperature (° C.) | Distilled weight % | Temperature (° C.) |
| 5 | 105 | 5 | 153 | 5 | 223 |
| 10 | 156 | 10 | 198 | 10 | 235 |
| 20 | 198 | 20 | 225 | 20 | 252 |
| 30 | 230 | 30 | 244 | 30 | 268 |
| 40 | 252 | 40 | 262 | 40 | 282 |
| 50 | 271 | 50 | 277 | 50 | 295 |
| 60 | 291 | 60 | 294 | 60 | 308 |
| 70 | 308 | 70 | 308 | 70 | 321 |
| 80 | 324 | 80 | 322 | 80 | 331 |
| 90 | 339 | 90 | 336 | 90 | 342 |
| 95 | 347 | 95 | 347 | 95 | 348 |

The various mixtures led to the appearance of existing sediments (IP375) and then underwent a step of the physical separation of sediments and catalyst residues using a metallic porous filter with trade mark Pall®. This physical sediments separation step was followed by a step of distilling the mixture in order to recover on the one hand, the atmospheric residue with a reduced sediment content, and on the other hand, the distillate cut.

TABLE 5

| Precipitation and separation of sediments | | | | |
|---|---|---|---|---|
| | No precipitation (not in accordance) | Mixture 1 (AR + Distillate cut X) | Mixture 2 (AR + Distillate cut Y) | Mixture 3 (AR + Distillate cut Z) |
| Proportion of atmospheric residue (AR) in the mixture (% m/m) | 100 | 50 | 50 | 50 |
| Proportion of distillate cut in the mixture (% m/m) | | 50 | 50 | 50 |
| Sediment content in the mixture (measured in accordance with IP375[a] % m/m) | — | 0.57[a] | 0.62[a] | 0.64[a] |
| Sediment content of recovered atmospheric residue AR (measured in accordance with IP390[b] % m/m) | 0.4 | <0.1[b] | <0.1[b] | <0.1[b] |

The operating conditions for the hydrocracking step coupled with the various treatment variations (separation of sediments with a precipitation step and recovery of distillate cut (variation B) or without a step of precipitation (variation A) of the atmospheric residue (AR) had an impact on the stability of the effluents obtained. This is illustrated by the sediment contents after aging measured in the atmospheric residue AR (350° C.+ cut) before (0.7% m/m) and after (<0.1% m/m) the step of precipitation and separation of the sediments, then recovering the distillate cut.

Thus, the atmospheric residues obtained in accordance with the invention constitute excellent fuel oil bases, in particular bunker fuel bases, with a sediment content after aging (IP390) of less than 0.1% by weight.

The atmospheric residue AR treated in the "mixture 3" case of Table 5, with a sediment content after aging of less than 0.1%, a sulphur content of 0.37% m/m and a viscosity of 590 cSt at 50° C., was mixed with diesel obtained from the process (Table 3) with a sulphur content of 0.05% m/m and a viscosity of 2.5 cSt at 50° C., in AR/diesel proportions of 90/10 (m/m). The mixture obtained had a viscosity of 336 cSt at 50° C., a sulphur content of 0.34% m/m and a sediment content after aging (IP390) of less than 0.1% by weight. This mixture thus constituted a high quality bunker fuel which could be sold with grade RMG or IFO 380, with a low sediment content and a low sulphur content. It could, for example, be burned outside ECA zones for 2020-25 without having to equip the vessel with a fume scrubber in order to dispose of the oxides of sulphur.

The invention claimed is:

1. A process for the treatment of a hydrocarbon feed containing at least one hydrocarbon fraction having a sulphur content of at least 0.1% by weight, an initial boiling point of at least 340° C. and a final boiling point of at least 440° C., said process comprising the following steps:

a) a fixed bed hydrotreatment step wherein the fixed bed hydrotreatment step is selected from the group consisting of hydrodenitrogenation, hydrodemetallization, hydrodeoxygenation, hydrodearomatization, hydroisomerization, hydrodealkylation, hydrocracking, hydrodeasphalting, Conradson Carbon reduction reactions and combinations thereof, and wherein the hydrocarbon feed and hydrogen are brought into contact over a hydrotreatment catalyst;

b) separating the effluent obtained from the hydrotreatment step a) into at least one light hydrocarbon fraction containing fuel bases and a heavy fraction containing compounds boiling at at least 350° C., c) a step of hydrocracking at least a portion of the heavy fraction obtained from step b) in at least one ebullated bed reactor containing a supported catalyst, d) a step of separating the effluent obtained from step c) to obtain at least one gaseous fraction and at least one heavy liquid fraction, e) a step of precipitating sediment, consisting of bringing into contact the heavy liquid fraction obtained from the separation step d) with a distillate cut wherein at least 20% by weight has a boiling point of 100° C. or more, for a period of less than 500 minutes, at a temperature in the range of 25° C. to 350° C., a pressure of less than 20 MPa, and in the presence of an oxidizing gas wherein the oxidizing gas is dioxygen, ozone or an oxide of nitrogen, and wherein part or all of the distillate cut originates from the separation step b), f) a step of physical separation of the sediments from the heavy liquid fraction obtained from the precipitation step e) to obtain a liquid hydrocarbon fraction, g) a step of recovering a liquid hydrocarbon fraction having a sediment content, measured in accordance with the ISO 10307-2 method, of 0.1% by weight or less, consisting of separating the liquid hydrocarbon fraction obtained from step f) from the distillate cut introduced during step e), and wherein the weight ratio between the distillate cut and the heavy fraction obtained from the separation step b) is in the range of 0.05 to 10.

2. The process according to claim 1, in which at least 25% by weight of the distillate cut has a boiling point of 100° C. or more.

3. A process for the treatment of a hydrocarbon feed containing at least one hydrocarbon fraction having a sulphur content of at least 0.1% by weight, an initial boiling point of at least 340° C. and a final boiling point of at least 440° C., said process comprising the following steps:

a) a fixed bed hydrotreatment step, wherein the fixed bed hydrotreatment step is selected from the group consisting of hydrodenitrogenation, hydrodemetallization, hydrodeoxygenation, hydrodearomatization, hydroisomerization, hydrodealkylation, hydrocracking, hydrodeasphalting, Conradson Carbon reduction reactions and combinations thereof, and wherein the hydrocarbon feed and hydrogen are brought into contact over a hydrotreatment catalyst;

b) separating the effluent obtained from the hydrotreatment step a) into at least one light hydrocarbon fraction containing fuel bases and a heavy fraction containing compounds boiling at at least 350° C., c) a step of hydrocracking at least a portion of the heavy fraction obtained from step b) in at least one ebullated bed reactor containing a supported catalyst, d) a step of separating the effluent obtained from step c) to obtain at least one gaseous fraction and at least one heavy liquid fraction, e) a step of precipitating sediment, consisting of bringing into contact the heavy liquid fraction obtained from the separation step d) with a distillate cut wherein at least 20% by weight has a boiling point of 100° C. or more, for a period of less than 500 minutes, at a temperature in the range of 25° C. to 350° C., a pressure of less than 20 MPa, and in the presence of an oxidizing gas wherein the oxidizing gas is dioxygen, ozone or an oxide of nitrogen, and wherein part or all of the distillate cut originates from the separation step b), f) a step of physical separation of the sediments from the heavy liquid fraction obtained from the precipitation step e) to obtain a liquid hydrocarbon fraction, g) a step of recovering a liquid hydrocarbon fraction having a sediment content, measured in accordance with the ISO 10307-2 method, of 0.1% by weight or less, consisting of separating the liquid hydrocarbon fraction obtained from step f) from the distillate cut introduced during step e), and wherein the weight ratio between the distillate cut and the heavy fraction obtained from the separation step b) is in the range of 0.05 to 10, and wherein at least 5% by weight of the distillate cut has a boiling point of at least 252° C.

4. The process according to claim 1, in which the distillate cut comprises hydrocarbons containing more than 12 carbon atoms.

5. The process according to claim 1, in which part or all of the distillate cut originates from separation steps b) and/or d) or from a refining process, or from a chemical process.

6. The process according to claim 1, in which a portion of the distillate cut separated in step g) is recycled to the precipitation step e).

7. The process according to claim 1, in which the hydrotreatment step a) comprises a first step a1) of hydrodemetallization carried out in one or more fixed bed hydrodemetallization zones and a subsequent second step a2) of hydrodesulphurization carried out in one or more fixed bed hydrodesulphurization zones.

8. The process according to claim 1, in which the hydrotreatment step a) is carried out at a temperature in the range of 300° C. to 500° C., under a partial pressure of hydrogen in the range of 5 MPa to 35 MPa, with an hourly space velocity of the hydrocarbon feed in the range from 0.1 $h^{-1}$ to 5 $h^{-1}$, and the quantity of hydrogen mixed with the feed is in the range of 100 $Nm^3/m^3$ to 5000 $Nm^3/m^3$.

9. The process according to claim 1, in which the hydrocracking step c) is carried out under an absolute pressure in the range of 2.5 MPa to 35 MPa, at a temperature in the range of 330° C. to 550° C., with an hourly space velocity in the range from 0.1 $h^{-1}$ to 10 $h^{-1}$, and the quantity of hydrogen mixed with the feed is 50 $Nm^3/m^3$ to 5000 $Nm^3/m^3$.

10. The process according to claim 1, in which the separation step f) is carried out by a filter, a separation membrane, a bed of organic or inorganic type filtration solids, an electrostatic precipitation, a centrifuging system, a decantation, an endless screw withdrawal or a physical extraction.

11. The process according to claim 1, in which the feed is selected from the group consisting of atmospheric residues, straight run vacuum residues, crude oils, topped crude oils, deasphalted oils, deasphalted resins, asphalts, deasphalted pitches, residues obtained from conversion processes, aromatic extracts obtained from lubricant base production lines, bituminous sands, derivatives of bituminous sands, shale oils, derivatives of shale oils, and mixtures thereof.

12. The process according to claim 11, in which the feed contains at least 1% of C7 asphaltenes and at least 5 ppm of metals.

13. The process according to claim 1, in which the liquid hydrocarbon fractions obtained from step f) or step g) are mixed with one or more fluxing bases selected from the group consisting of light cycle oils from catalytic cracking, heavy cycle oils from catalytic cracking, catalytic cracking residue, a kerosene, a diesel, a vacuum distillate and a decanted oil and the distillate cut, to obtain a fuel oil.

14. The process according to claim 1, in which the oxidizing gas is dioxygen, ozone or an oxide of nitrogen, obtained from separation steps b) and/or c).

15. A process for the treatment of a hydrocarbon feed containing at least one hydrocarbon fraction having a sulphur content of at least 0.1% by weight, an initial boiling point of at least 340° C. and a final boiling point of at least 440° C., said process comprising the following steps:

a) a fixed bed hydrotreatment step, wherein the fixed bed hydrotreatment step is selected from the group consisting of hydrodenitrogenation, hydrodemetallization, hydrodeoxygenation, hydrodearomatization, hydroisomerization, hydrodealkylation, hydrocracking, hydrodeasphalting, Conradson Carbon reduction reactions and combinations thereof, and wherein the hydrocarbon feed and hydrogen are brought into contact over a hydrotreatment catalyst;

b) separating the effluent obtained from the hydrotreatment step a) into at least one light hydrocarbon fraction containing fuel bases and a heavy fraction containing compounds boiling at at least 350° C., c) a step of hydrocracking at least a portion of the effluent obtained from step a) or at least a portion of the heavy fraction obtained from step b) in at least one ebullated bed reactor containing a supported catalyst, d) a step of separating the effluent obtained from step c) to obtain at least one gaseous fraction and at least one heavy liquid fraction, e) a step of precipitating sediment, consisting of bringing into contact the heavy liquid fraction obtained from the separation step d) with a distillate cut wherein at least 20% by weight has a boiling point of 100° C. or more, for a period of less than 500 minutes, at a temperature in the range of 25° C. to 350° C., a pressure of less than 20 MPa, and in the presence of an oxidizing gas, f) a step of physical separation of the sediments from the heavy liquid fraction obtained from the precipitation step e) to obtain a liquid hydrocarbon fraction, g) a step of recovering a liquid hydrocarbon fraction having a sediment content, measured in accordance with the ISO 10307-2 method, of 0.1% by weight or less, consisting of separating the liquid hydrocarbon fraction obtained from step f) from the distillate cut introduced during step e), and wherein the weight ratio between the distillate cut and the heavy fraction obtained from the separation step b) is in the range of 0.05 to 10, and in which part or all of the distillate cut originates from separation step b).

16. The process according to claim 3, in which the oxidizing gas is dioxygen, ozone or an oxide of nitrogen.

17. The process according to claim 15, in which the oxidizing gas is dioxygen, ozone or an oxide of nitrogen.

18. The process according to claim 1, in which step e) is a step of precipitating sediment, consisting of bringing into contact the heavy liquid fraction obtained from the separation step d) with a distillate cut wherein at least 20% by weight has a boiling point of 100° C. or more, for a period of less than 500 minutes, at a temperature in the range of 25° C. to 350° C., a pressure of less than 20 MPa, and in the presence of only an oxidizing gas.

* * * * *